United States Patent [19]

Taravella

[11] Patent Number: 4,843,783

[45] Date of Patent: Jul. 4, 1989

[54] CASING TRIM

[75] Inventor: Salvatore R. Taravella, Buffalo, N.Y.

[73] Assignee: National Gypsum Company, Dallas, Tex.

[21] Appl. No.: 177,297

[22] Filed: Apr. 4, 1988

[51] Int. Cl.[4] ..... E04B 1/00

[52] U.S. Cl. ..... 52/98; 52/212; 52/94; 52/716; 52/727

[58] Field of Search ..... 52/94, 98, 100, 287, 52/312, 716, 717, 718, 727, 730, 731, 747, 212

[56] References Cited

U.S. PATENT DOCUMENTS

| | | | |
|---|---|---|---|
| 908,858 | 1/1909 | Goddard | 52/212 |
| 2,779,983 | 2/1957 | Sundelin | 52/716 X |
| 2,843,889 | 7/1958 | Keller | 52/716 |
| 2,853,750 | 10/1958 | Davies et al. | 52/717.1 |
| 3,355,852 | 12/1967 | Lally | 52/730 X |
| 3,413,775 | 12/1968 | Katz | 52/727 |
| 3,422,584 | 1/1969 | Howard | 52/98 |
| 4,289,818 | 10/1981 | Casamayor | 52/98 X |
| 4,461,128 | 7/1984 | Knoebl | 52/747 X |

FOREIGN PATENT DOCUMENTS

| | | | |
|---|---|---|---|
| 2235306 | of 1973 | Fed. Rep. of Germany | 52/727 |
| 1371128 | of 1964 | France | 52/312 |

OTHER PUBLICATIONS

Cheney Fascia Panels, Certain Teed Solid Vinyl Accessories, 1985, Sweets Catalog.

Customform Panel Systems, 1985, Sweets Catalog vol. 4.

*Primary Examiner*—David A. Scherbel

*Assistant Examiner*—Jerrold D. Johnson

*Attorney, Agent, or Firm*—Laird F. Miller; Robert F. Hause

[57] ABSTRACT

A casing trim, and the combination therewith of a flat vinyl strip, and the method of concealing building wooden casings and the like, wherein the casing trim is nailed to the edge portion of a casing, with one flange of the casing trim extending over an edge of the casing, and the perpendicularly directed face portion has a channel which receives and retains an edge of the flat vinyl strip.

7 Claims, 2 Drawing Sheets

CASING TRIM

BACKGROUND OF THE INVENTION

This invention relates to trim elements for concealing portions of buildings, such as door and window casings, moldings, fascia boards and porch posts and particularly combinations of elements including scrap siding materials, to match the appearance of the concealed trim element with the sliding appearance, during the process of applying thin, elongate siding to a home or other building.

U.S. Pat. No. 4,479,331 discloses the use of specially designed vinyl extrusions for concealing wood window sash, a concept which would require different extruded facings for each size and shape of sash.

U.S. Pat. No. 4,461,128 discloses a combination of a standard finish trim channel employed as a soffit panel supporting inner channel and a specially designed corner member, which elements cooperate to support a soffit panel. This specially designed corner member is nailed to the fascia, and is further specially designed to include means for receiving and holding the bottom edge of a fascia concealing panel.

U.S. Pat. No. 3,413,775 discloses a combination of cornices and substrates for providing a new facing over a column of rectangular cross section. The four flat substrates, or facings, are adhered to the column sidewalls, and the cornices each have a pair of perpendicularly directed channels, which receive and protect the vertical edges of the perpendicularly disposed facings. The cornices are held in place by their grasping of the facings' edges. The cornices are not fastened directly to the column.

SUMMARY OF THE INVENTION

The present invention provides a novel means and method for concealing those portions of a house, or other structure, which portions are not covered during application of thin elongate siding.

The invention employs an elongate vinyl casing trim, which is fastened along one elongate edge of a wooden substrate element. The novel casing trim includes an edge concealing flange, and, perpendicular thereto, an elongate channel which includes a rearwardly disposed nailing flange and a forwardly disposed front flange. This casing trim is nailed to the front face of the substrate element with the edge concealing flange concealing the edge of the substrate element.

An elongate edge of a flat strip, cut from elongate siding material, of any desired width, is inserted into the channel of the casing trim, so that the flat strip conceals the face of the substrate element. The opposite elongate edge of the flat strip can be held by a similar casing trim, or by any other means. The edge concealing flange is preferably formed with a plurality of elongate shallow grooves, permitting the use of a single form of casing trim on substrate elements of widely varying widths of substrate element edges, by breaking off portions of the edge concealing flange along any of the several shallow grooves.

It is an object of the invention to provide an elongate casing trim for concealing the edge of an elongate structural element and simultaneously providing a perpendicularly directed elongate channel for receiving and retaining in place the side edge of an elongate sheet of facing material.

It is a further object to provide such a casing trim, made of elongate vinyl, for use in combination with elongate thin strips of vinyl which are cut from elongate strips of vinyl siding.

It is a further object to provide such a casing trim product which is readily modifiable for use on a relatively wide range of edge widths of substrate elements.

It is a still further object of the invention to provide a novel method for concealing a plurality of elongate structural elements.

BRIEF DESCRIPTION OF THE DRAWINGS

These and other objects and advantages of the invention will be more readily apparent when considered in relation to the preferred embodiments, as set forth in the specification, and shown in the drawings, in which.

DESCRIPTION OF THE PREFERRED EMBODIMENTS

Figure 1:
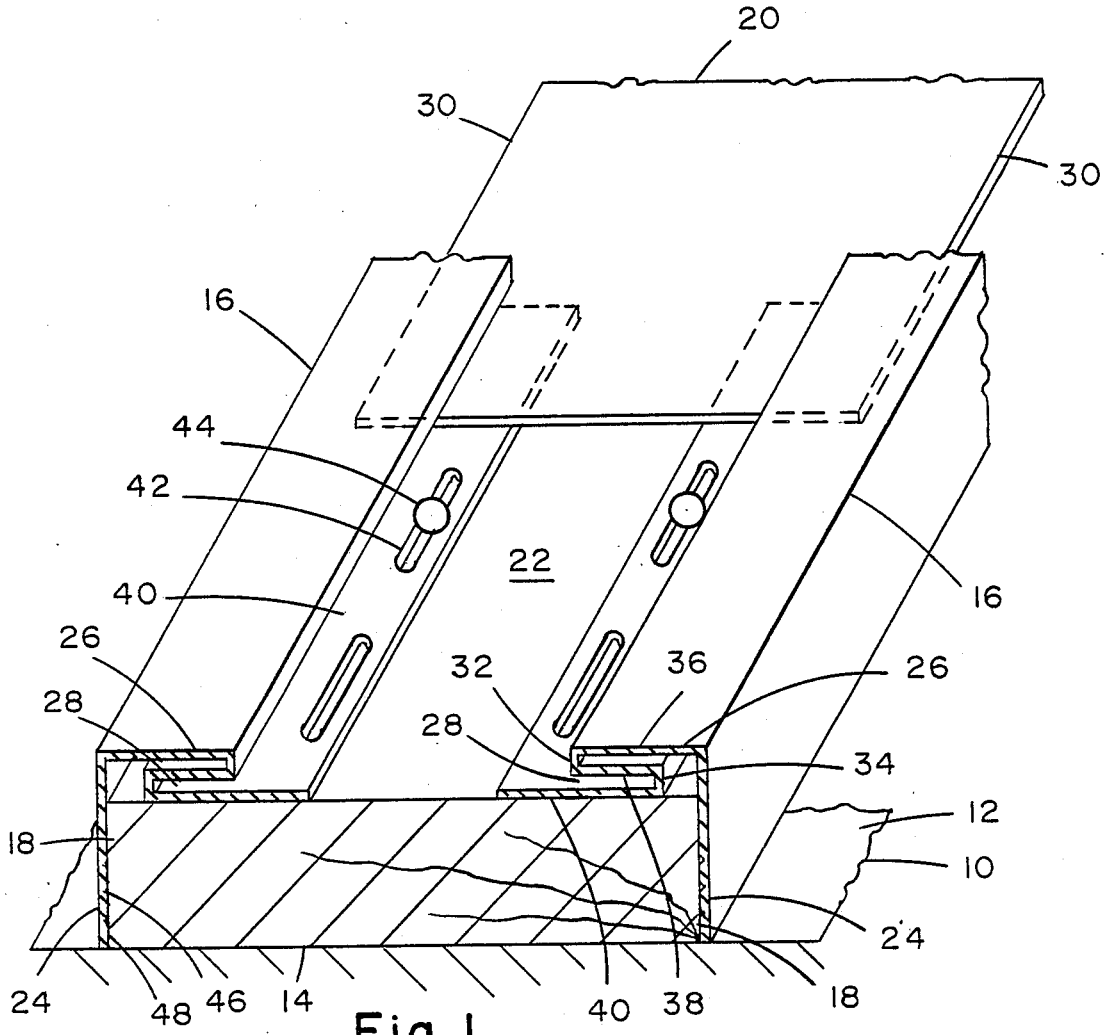
FIG. 1 is an isometric, sectional end view of a wooden window casing with a section of elongate casing trim nailed onto each front edge of the window casing and a flat sheet of vinyl in the process of being slid into the casing trim, in accordance with the invention.

Referring to FIG. 1, there is shown a wall 10, on the face 12 of which there is disposed an elongate, wide wooden casing 14. Face 12 may be a side of a home, to which thin elongate siding is being applied. Casing 14 is decoratively concealed, in accordance with the invention, by an elongate casing trim 16 nailed to casing 14 along each side edge 18 of casing 14, and an elongate thin flat vinyl strip 20, which may match, or even be made from scraps of, the thin elongate siding being applied, disposed over the face 22 of casing 14.

Each casing trim 16 includes an edge concealing flange 24 which is disposed along the surface of a side edge 18 of casing 14, and face portion 26 which extends perpendicular to the edge concealing flange 24 and is disposed over the face 22 of casing 14, adjacent an edge thereof. The face portion 26 is formed to include an inwardly directed channel 28. The channels 28 of each of the two casing trims 16 are directed toward each other, and the flat strip 20 has two side edges 30 disposed respectively in the two channels 28.

In the structure of FIG. 1, the casing trims 16 are manufactured by a process known as postforming, wherein a flat strip of vinyl is extruded and immediately thereafter, before cooling and hardening, is folded along three elongate lines, forming the right angle between the edge concealing flange 24 and the face portion 26, and forming two 180° folds 32, 34, dividing the face portion 26 into three elongate portions, edge portion 36, intermediate portion 38 and the bottom flange 40. The channel 28 is between the intermediate portion 38 and the bottom flange 40. This postformed vinyl casing trim, once cooled, is relatively rigid.

The bottom flange 40, disposed against the casing face 22 has a plurality of lengthwise extending nail slots 42. Nails 44 affix the casing trim 16 to the casing 14.

A plurality of shallow, narrow parallel grooves 46 are formed in the inner surface 48 of the edge concealing flange 24. Grooves 46 make it readily possible to break off elongate portions of the edge concealing flange 24, so that a casing trim 16 with a relatively wide edge concealing flange 24 can be easily modified for use on wooden casing of relatively narrower edge dimension.

Figure 2:
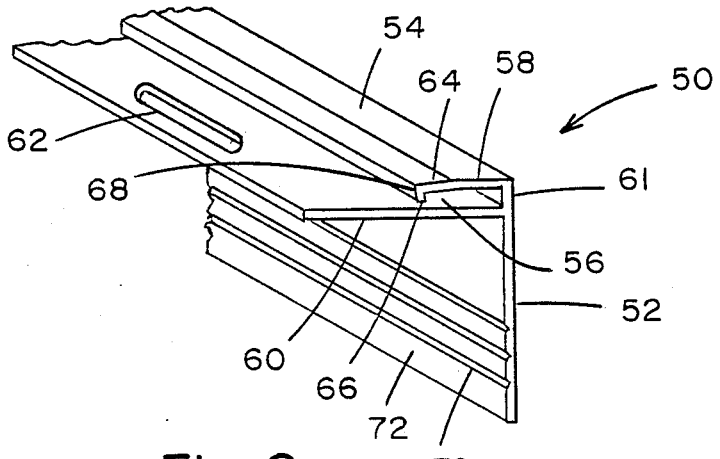
FIG. 2 is an isometric, end view of a modified section of elongate casing trim, also constructed for use in accordance with the invention.

Referring to FIG. 2, there is shown a modified form of casing trim 50, formed by extrusion of vinyl through a profiled die. Casing trim 50 includes an edge concealing flange 52, and a face portion 54 which extends perpendicular to the edge concealing flange 52. The face portion 54 is formed to include an inwardly directed channel 56, located between a relatively narrow top flange 58 and a relatively wide bottom flange 60, adjoined by a web 61. The bottom flange 60 has formed therein a plurality of lengthwise extending nail slots 62. The top flange 58 is preferably formed with a downwardly and inwardly angled portion 64 ending in a downwardly directed, small rib 66 at the downward and inward terminus 68. Rib 66 is provided to lay relatively tightly against a flat vinyl strip 20.

The casing trim 50 will be understood as suitable for use in receiving and retaining the side edges 30 of a flat strip 20, functioning essentially as a casing trim 16 functions in the structure of FIG. 1.

The edge concealing flange 52 of casing trim 50 has a plurality of shallow narrow parallel grooves 70 in the inner surface 72, adapted to function similar to the grooves 46 of casing trim 16.

Figure 3:
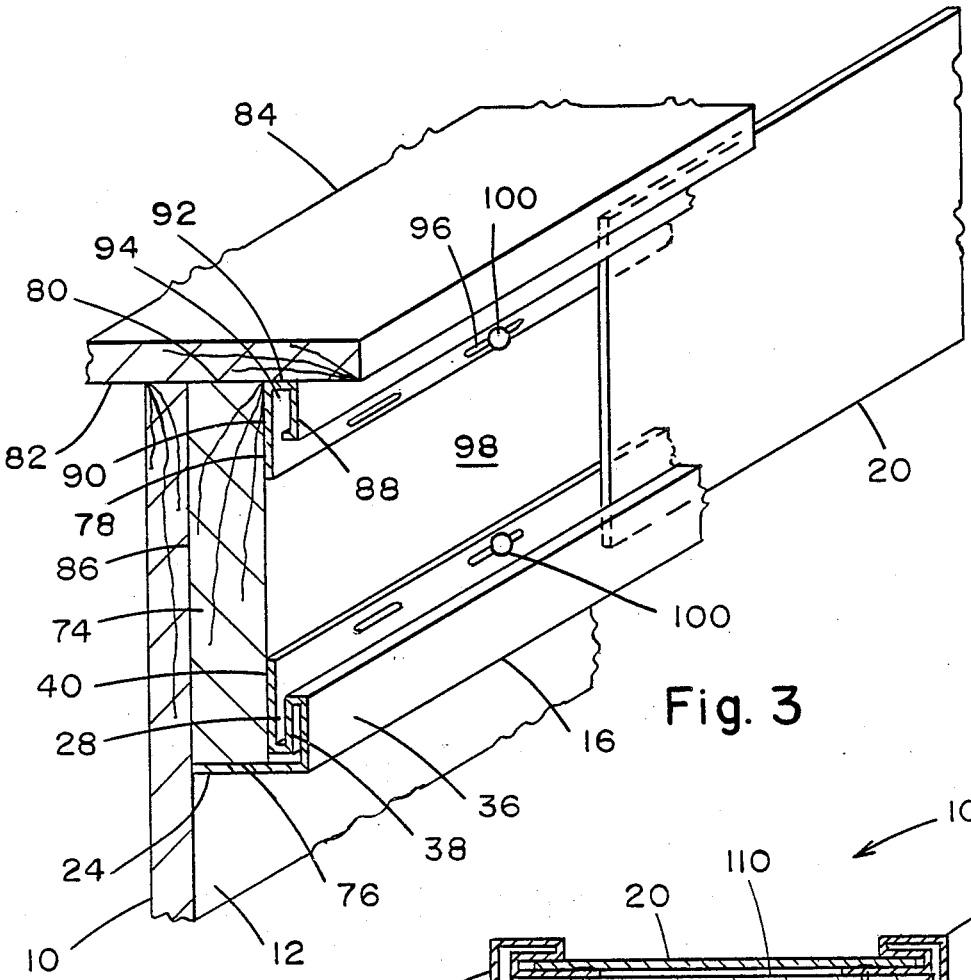
FIG. 3 is an isometric, sectional end view of a wooden gable fascia board abutting the bottom side of roof boards, with the novel casing trim at the bottom edge of the fascia board acting in combination with a standard finish trim channel to receive and retain an elongate flat sheet of vinyl.

In FIG. 3, there is shown a gable fascia board 74, the concealment of which involves the use of a casing trim 16 along the bottom edge 76 of the fascia board 74, and a downwardly opening channel member 78, with a flat vinyl strip 20 disposed and retained thereby. The structure of FIG. 3 is used wherever a wooden trim member has only one edge surface exposed, such as the bottom edge 76 of board 74. The top edge 80 of board 74 is located against the bottom surface 82 of roof boards 84. The gable fascia board 74 has a back surface 86 disposed against the face 12 of a wall 10.

The downwardly opening channel member 78 has a structure which includes a relatively narrow top flange 88 and a relatively wide bottom flange 90, adjoined by a web 92, forming therewithin a downwardly opening channel 94. Bottom flange 90 has a plurality of lengthwise extending nail slots 96.

Channel member 78 and casing trim 16 are both affixed to the face 98 of board 74 by nails 100.

Figure 4:
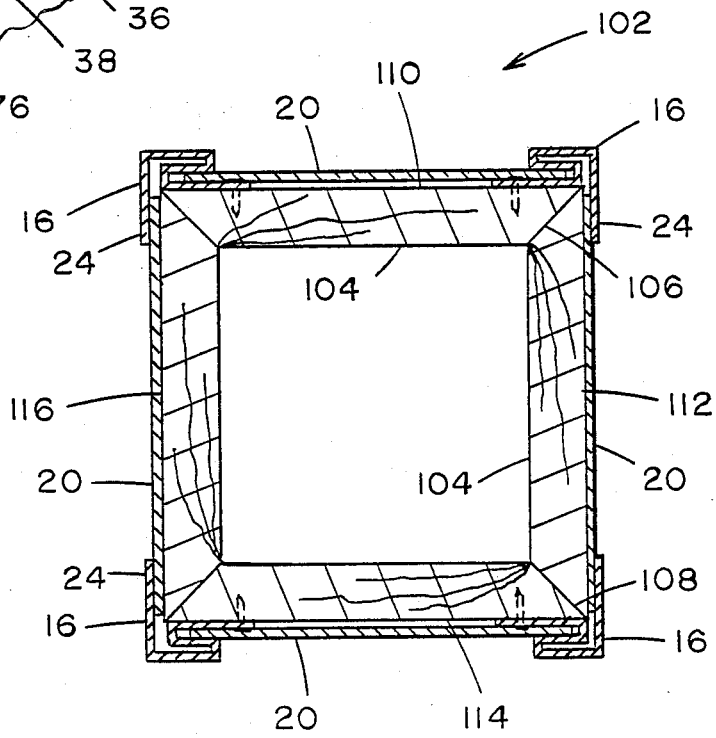
FIG. 4 is a sectional top view of a porch post with the four sides covered with elongate flat strips of vinyl which are retained in place by the use of four elongate casing trims, all in accordance with the invention.

FIG. 4 shows a porch post 102, constructed of four vertically extending wooden boards 104, adjoined at their edges 106 to form the corners 108 of post 102.

Two opposed sides 110 and 114 of post 102 are each concealed by a pair of casing trims 16 with a flat vinyl strip 20 retained therebetween. The other two opposed sides 112 and 116 are each concealed by a flat vinyl strip 20, each of which is disposed under and retained in place by the edge concealing flanges 24 of a pair of casing trims 16, located along the two edges of sides 112 and 116.

Having completed a detailed disclosure of the preferred embodiments of my invention, so that others may practice the same, I contemplate that variations may be made without departing from the essence of the invention.

I claim:

1. In combination, a building structure to which vinyl siding is affixed, a concealed member of said building structure, to which said member vinyl siding is not affixed, and materials concealing said concealed member, said concealed member being a single wide wooden casing board having a relatively wide face and two narrow side edges, said concealed member having concealing material concealing said face and said two side edges, said concealing materials comprising two vinyl casing trims and a thin flat sheet of vinyl material which is similar to said vinyl siding, said casing trims each consisting essentially of an elongate edge concealing flange and an elongate face portion extending perpendicularly from one edge of said edge concealing flange, said face portion having a relatively wide bottom flange and elongate means in parallel spaced relation to said bottom flange, said elongate means forming, in combustion with said bottom flange, an elongate channel opening in a direction away from said edge concealing flange, whereby an edge of a thin flat sheet of vinyl may be received and retained to hold said sheet of vinyl in a plane perpendicular to said edge concealing flange, each said casing trim being affixed to said concealed member with said edge concealing flange concealing a respective said concealed member edge and said face portion disposed along a respective edge of said concealed member face, said thin flat sheet of vinyl material concealing a portion of the face of said concealed member, said thin flat sheet of vinyl material being disposed between said two casing trims and having two edges which are disposed within and retained in place against said wooden casing solely by said casing trim elongate channels.

2. The combination of claim 1 wherein said casing trim is a postformed rigid vinyl product.

3. The combination of claim 1 wherein said casing trim is an extruded rigid vinyl product.

4. The combination of claim 1 wherein said casing trim is affixed to said concealed member by fastening means which affix said relatively wide bottom flange to said concealed member face.

5. The method of concealing an elongate, flat, wooden board member of a building structure, to which said building structure vinyl siding is also being applied, wherein said wooden board member comprises a flat face surface and two adjacent relatively narrow edge surfaces comprising the steps of affixing a vinyl casing trim to each of two elongate corners of said wooden board building structure member, each said casing trim consisting essentially of an elongate edge concealing flange and an elongate face portion extending perpendicularly from one edge of said edge concealing flange, said face portion having a relatively wide bottom flange and elongate means in parallel spaced relation to said bottom flange, said elongate means forming, in combination with said bottom flange, an elongate channel opening in a direction away from said edge concealing flange, whereby an edge of a thin flat sheet of vinyl may be received and retained to hold said sheet of vinyl in a plane perpendicular to said edge concealing flange, with said elongate edge concealing flange of each said casing trim respectively concealing all of one of said two relatively narrow edge surfaces of said wooden board building structure member and with said elongate face portion of each said casing trim respectively concealing a portion of said face adjacent surface of said wooden board building structure member, and subsequently inserting one respective elongate edge of a thin flat sheet of vinyl, of a material similar to said vinyl siding material, into said elongate channel opening of each of said respective casing trims, thereby retaining said sheet of vinyl over said adjacent face surface of said building structure member, providing retention of said sheet of vinyl against said adjacent face surface solely by said two casing trims.

6. The method of claim 5 further comprising the steps of forming in each said casing trim a plurality of narrow shallow grooves in said elongate edge concealing flange in parallel spaced relation to the edge of said flange, and subsequently breaking off a portion of the width of said flange along one of said grooves to conform the width of said flange to substantially the width of said relatively narrow edge portion of said wooden board building structure member.

7. The method of claim 5 further comprising the step of nailing said relatively wide bottom flange of each said casing trim to said face surface of said wooden member.

* * * * *